US011273665B2

(12) United States Patent
Boettcher et al.

(10) Patent No.: US 11,273,665 B2
(45) Date of Patent: Mar. 15, 2022

(54) ERASER ASSEMBLY

(71) Applicant: Amazing Magnets, LLC, Anaheim, CA (US)

(72) Inventors: Timothy Paul Boettcher, Orange, CA (US); Luke T. Bilisoly, Fullerton, CA (US)

(73) Assignee: Amazing Magnets, LLC, Anaheim, CA (US)

( * ) Notice: Subject to any disclaimer, the term of this patent is extended or adjusted under 35 U.S.C. 154(b) by 0 days.

(21) Appl. No.: 15/682,819

(22) Filed: Aug. 22, 2017

(65) Prior Publication Data

US 2018/0056710 A1 Mar. 1, 2018

Related U.S. Application Data

(60) Provisional application No. 62/378,354, filed on Aug. 23, 2016.

(51) Int. Cl.

| | |
|---|---|
| ***B43L 21/04*** | (2006.01) |
| ***B43L 19/00*** | (2006.01) |
| ***A47L 13/16*** | (2006.01) |

(52) U.S. Cl.

CPC ..... *B43L 21/04* (2013.01); *A47L 13/16* (2013.01); *B43L 19/0062* (2013.01); *B43L 19/0068* (2013.01)

(58) Field of Classification Search

CPC ..... A47L 13/16; A47L 25/00; B43L 19/0062; B43L 19/04; B43L 19/0056; B43L 19/0068; B43L 21/00; B43L 21/04

USPC ..... 220/23.89, 811, 812, 813, 380; 15/209.1

See application file for complete search history.

(56) References Cited

U.S. PATENT DOCUMENTS

| | | | | |
|---|---|---|---|---|
| 505,733 | A * | 9/1893 | Torrey | B43L 19/0068 15/434 |
| 1,943,647 | A * | 1/1934 | Weller | A47L 1/15 222/130 |
| 2,297,806 | A | 10/1942 | Smith | |
| 2,385,859 | A | 10/1945 | Jacobson | |
| 2,644,212 | A | 7/1953 | Markowitz | |

(Continued)

FOREIGN PATENT DOCUMENTS

| | | | |
|---|---|---|---|
| CN | 204095369 | 1/2015 | |
| EP | 1543993 A1 * | 6/2005 | B43L 21/00 |

(Continued)

OTHER PUBLICATIONS

EspaceNet Translation Min Ja Kim (KR 100946430) (Year: 2009).*

(Continued)

*Primary Examiner* — Laura C Guidotti
*Assistant Examiner* — Makena S Markman
(74) *Attorney, Agent, or Firm* — Knobbe Martens Olson & Bear, LLP

(57) ABSTRACT

An eraser assembly is provided that includes a housing, a tray, and a coupler disposed between a surface of the tray and a surface of the housing. The housing has a concave shape including an interior portion. The tray has a retaining portion disposed in the interior portion and a mounting portion disposed opposite of the retaining portion. The coupler is configured to releasably hold the tray to the housing. An eraser insert configured to be disposed in the interior portion of the housing and to be enclosed by the tray.

6 Claims, 13 Drawing Sheets

(56) References Cited

U.S. PATENT DOCUMENTS

| | | | | |
|---|---|---|---|---|
| 2,964,812 | A | 12/1960 | Cook | |
| 3,159,372 | A | 12/1964 | McIntosh | |
| 3,387,341 | A | 6/1968 | Mates et al. | |
| 4,941,226 | A * | 7/1990 | Kemper | A45D 34/04 132/315 |
| 5,083,337 | A * | 1/1992 | Jones | A47L 25/00 15/104.94 |
| 6,199,240 | B1 * | 3/2001 | You | A47L 1/06 15/121 |
| D441,021 | S | 4/2001 | Roush | |
| 6,305,864 | B1 | 10/2001 | Nguyen | |
| 6,718,708 | B2 | 4/2004 | Donoghue | |
| D493,836 | S | 8/2004 | Cegelski et al. | |
| 6,846,122 | B1 | 1/2005 | Liao | |
| 6,945,503 | B2 | 9/2005 | Cohen | |
| 7,264,414 | B2 * | 9/2007 | McReynolds | A47L 1/15 401/136 |
| 7,313,841 | B2 * | 1/2008 | Huang | A01K 63/10 119/264 |
| 7,496,994 | B1 | 3/2009 | Headley | |
| 7,527,447 | B2 | 5/2009 | Huang | |
| 7,618,013 | B2 | 11/2009 | Elmer et al. | |
| 8,235,262 | B1 | 8/2012 | Sakdol | |
| 8,439,585 | B2 * | 5/2013 | Silva Rubio | B43K 23/002 206/214 |
| 8,464,447 | B2 * | 6/2013 | Pemberton | G09F 13/08 40/600 |
| 9,153,152 | B1 | 10/2015 | Elmer | |
| 9,161,586 | B2 | 10/2015 | Brown | |
| 9,320,409 | B1 * | 4/2016 | Lu | A47L 11/4061 |
| 9,409,437 | B2 | 8/2016 | Green et al. | |
| 9,662,926 | B1 | 5/2017 | Boettcher et al. | |
| 10,220,649 | B2 | 3/2019 | Boettcher et al. | |
| 2004/0205919 | A1 * | 10/2004 | Sims | A47L 13/16 15/209.1 |
| 2005/0251942 | A1 * | 11/2005 | Gunnarsson | A47L 13/18 15/227 |
| 2006/0000043 | A1 * | 1/2006 | Jou-Chen | A47L 13/16 15/231 |
| 2006/0194028 | A1 | 8/2006 | Moore | |
| 2007/0014624 | A1 | 1/2007 | Fogelson et al. | |
| 2007/0194187 | A1 * | 8/2007 | Amron | B42F 1/04 248/206.5 |
| 2008/0166173 | A1 | 7/2008 | Gibbons | |
| 2008/0240840 | A1 | 10/2008 | Huang | |
| 2009/0126137 | A1 * | 5/2009 | Lyons | A47L 13/18 15/210.1 |
| 2009/0193629 | A1 * | 8/2009 | Suenaga | G09F 7/04 24/303 |
| 2010/0068422 | A1 * | 3/2010 | Keyes | G09F 7/04 428/13 |
| 2010/0219217 | A1 | 9/2010 | Andochick | |
| 2011/0091860 | A1 | 4/2011 | Supera et al. | |
| 2013/0306206 | A1 * | 11/2013 | Quinnan | A45C 13/08 150/105 |
| 2016/0186789 | A1 * | 6/2016 | Nelson | F16B 1/00 24/303 |
| 2016/0220088 | A1 | 8/2016 | Zohar et al. | |
| 2017/0259612 | A1 | 9/2017 | Boettcher et al. | |
| 2020/0384795 | A1 | 12/2020 | Boettcher et al. | |

FOREIGN PATENT DOCUMENTS

| | | | | |
|---|---|---|---|---|
| EP | 3 067 876 | B1 | 12/2017 | |
| EP | 3 079 140 | B1 | 10/2018 | |
| FR | 2825594 | A1 * | 12/2002 | B43L 21/04 |
| GB | 273413 | A | 7/1927 | |
| KR | 20-0321360 | | 7/2003 | |
| KR | 10-0946430 | | 3/2010 | |
| KR | 10-2013-0137873 | | 12/2013 | |
| WO | WO-2017083374 | A1 * | 5/2017 | A47L 13/44 |
| WO | WO 2018/039177 | | 3/2018 | |

OTHER PUBLICATIONS

EspaceNet Translation Kyung (KR 200321360) (Year: 2003).*

EspaceNet Translation of Song (KR 20130137873) (Year: 2013).*

FR-2825594-A1 EspaceNet translation (Year: 2002).*

International Search Report and Written Opinion issued in PCT Application No. PCT/US2017/047923, dated Dec. 4, 2017 in 15 pages.

International Preliminary Report on Patentability in International Application No. PCT/US2017/047923, dated Feb. 26, 2019 in 11 pages.

"The StikkiWorks Co.—Magnetic Marker Rings", http://www.stikkiworks.com/prodring, printed from the internet Dec. 11, 2015.

* cited by examiner

ERASER ASSEMBLY

INCORPORATION BY REFERENCE TO ANY PRIORITY APPLICATIONS

The present application claims priority benefit under 35 U.S.C. § 119(e) to U.S. Provisional Application No. 62/378,354, filed Aug. 23, 2016, which is hereby incorporated by reference herein in its entirety.

BACKGROUND OF THE INVENTION

Field of the Invention

The present disclosure relates to an eraser assembly for use on white boards, glass boards, and the like.

Description of the Related Art

Blackboards and whiteboards have long been in use. These devices provide a convenient space for instructors and meeting attendees to record their thoughts for a group using chalk and pens. Whiteboard, and more recently glassboards, have gained popularity as more convenient and cleaner to use than blackboards. Glassboards, which are gaining in popularity form part of, or are mounted to a wall surface. A layer of glass is the structure upon which the user writes. These devices improve on whiteboards in being more durable, and being more aesthetically pleasing with a sleek, modern look.

A conventional way to clean such boards is to use an eraser to rub the surface of the board. The surface of the eraser that rubs the board is configured to remove the markings from the board to clean the board for subsequent use. The conventional black or whiteboard eraser serves this function reasonably well. However because the surface of the eraser that rubs the surface of the board is generally integrally formed with or non-removably secured to the body of the eraser that the user grips the useful life of the entire eraser is limited by the durability of the surface that rubs the board. While a user can try to extend the life of the eraser, the board cleaning capacity of the eraser will steadily decline. While a user is free to frequently replace the entire eraser, this practice leads to waste, expense and inventory management issues, particularly for a school or large office with a large number of rooms and black, white or glass boards.

SUMMARY OF THE INVENTION

Accordingly, there is a need for an eraser for cleaning black, white, and glassboards and other similar boards that is more long lasting. The eraser preferably enables a user to quickly change the surface that rubs the board for cleaning the board. The eraser can be in the form of an assembly which can have an eraser insert mounted thereto. The eraser can be in the form of an assembly which can store one or more eraser inserts therein to reduce inventory issues. The eraser can be in the form of an assembly that facilitates the re-use of at least some of the components of the eraser in a convenient and economical way.

In one embodiment, an eraser assembly is provided that includes a housing, a tray, and a first eraser inserter. The housing has a concave shape that includes an interior portion. The tray has a retaining portion and a recess disposed opposite of the retaining portion. The retaining portion is disposed in the interior portion of the housing when the eraser assembly is assembled. The recess is exposed when the tray is coupled with the housing with the retaining portion disposed in the interior portion. The first eraser insert is configured to be disposed in the recess. The second eraser insert is configured to be disposed in interior portion and in the retaining portion.

In another embodiment, an eraser assembly is provided that includes a housing, a tray, and a coupler disposed between a surface of the tray and a surface of the housing. The housing has a concave shape including an interior portion. The tray has a retaining portion disposed in the interior portion and a mounting portion disposed opposite of the retaining portion. The coupler is configured to releasably hold the tray to the housing. An eraser insert configured to be disposed in the interior portion of the housing and to be enclosed by the tray.

In another embodiment, an eraser assembly is provided that includes a housing, a mounting portion, and an eraser insert. The housing has a convex form. The mounting portion comprising a magnet configured to magnetically secure the eraser assembly to a board, e.g., a blackboard, a whiteboard, and a glassboard. The eraser insert is configured to couple with the mounting portion. The eraser insert configured to at least partially receive the magnet when so coupled.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
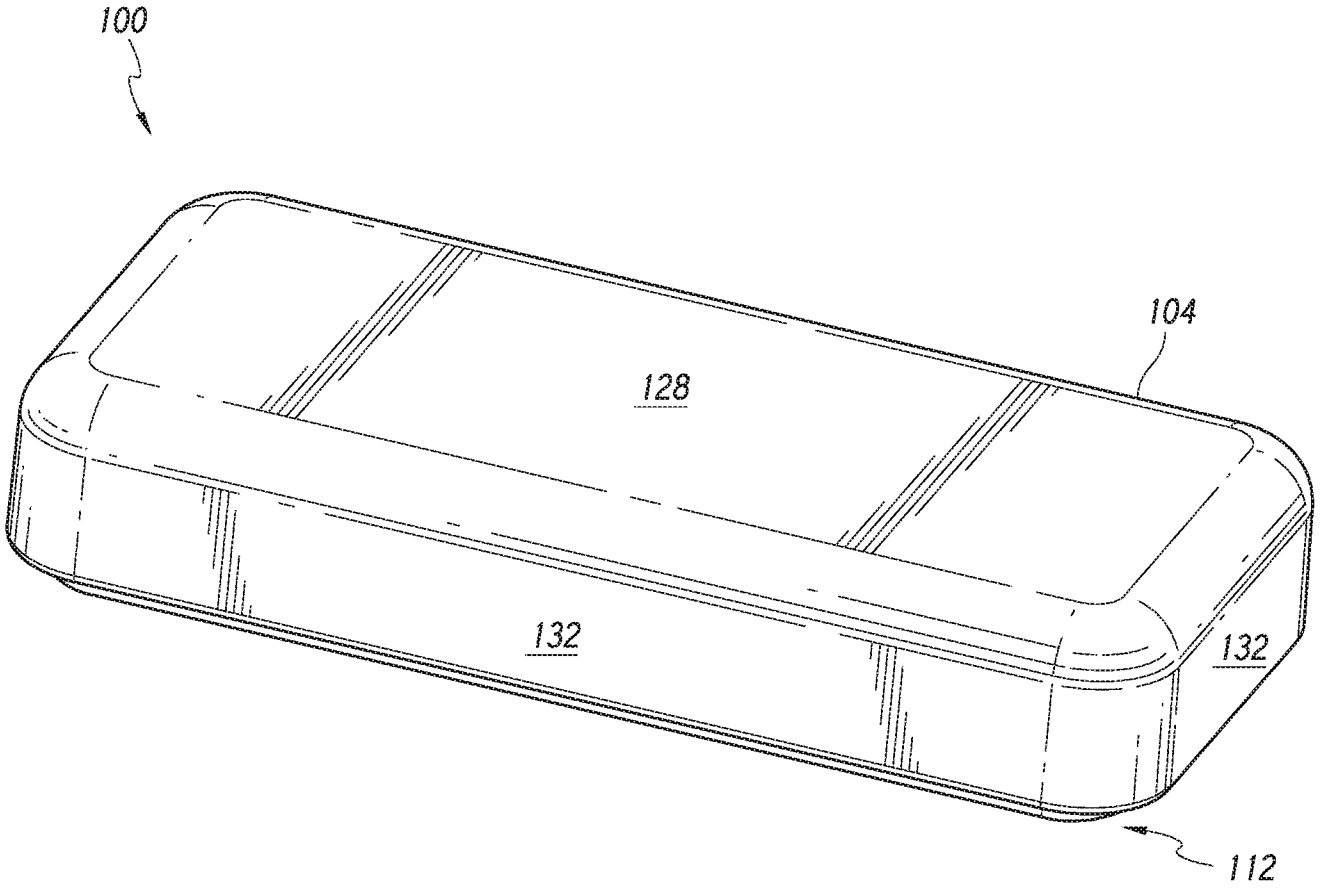
FIG. 1 is a top perspective view of an eraser assembly according to one embodiment disclosed herein.
Figure 2:
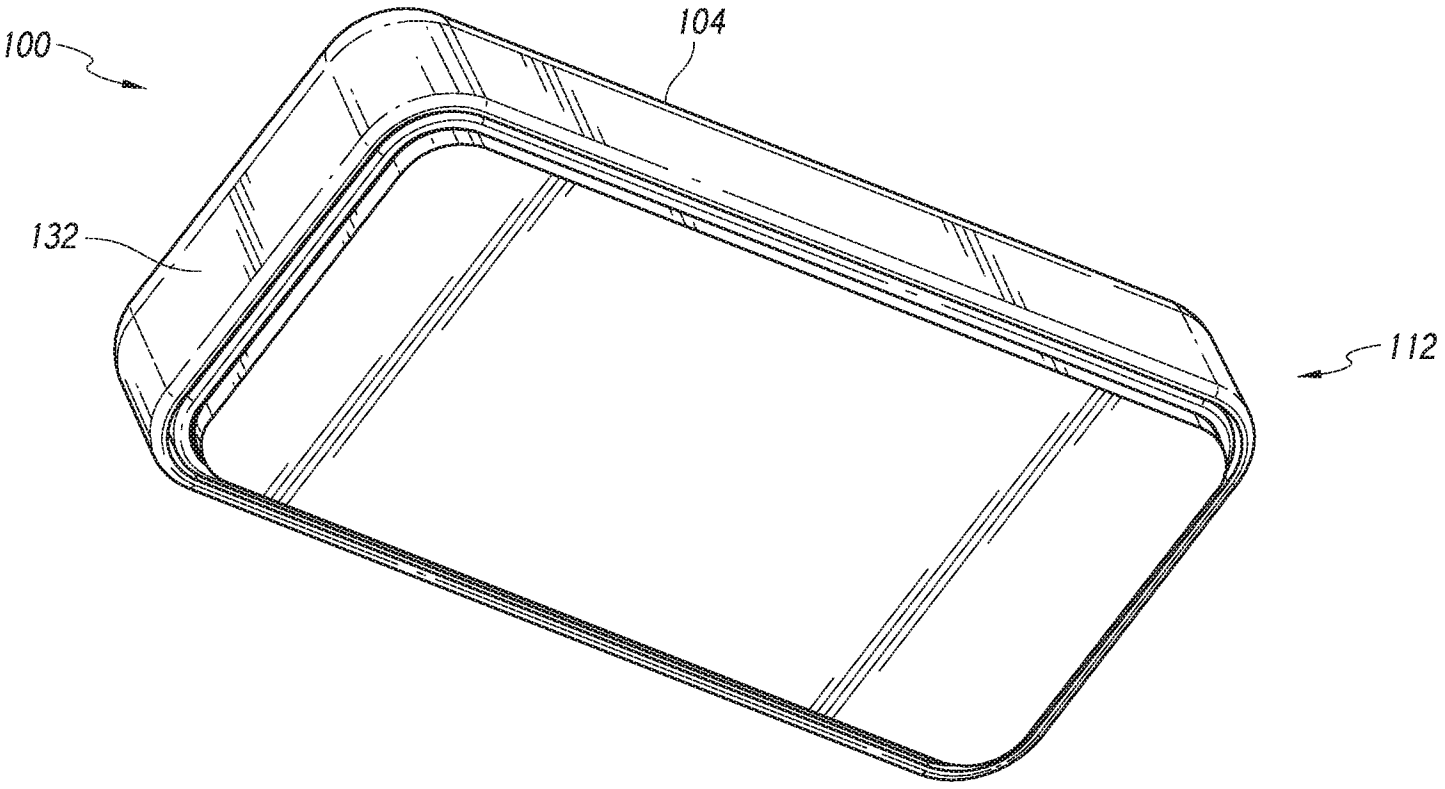
FIG. 2 is a bottom perspective view of the eraser assembly of FIG. 1.
Figure 3:
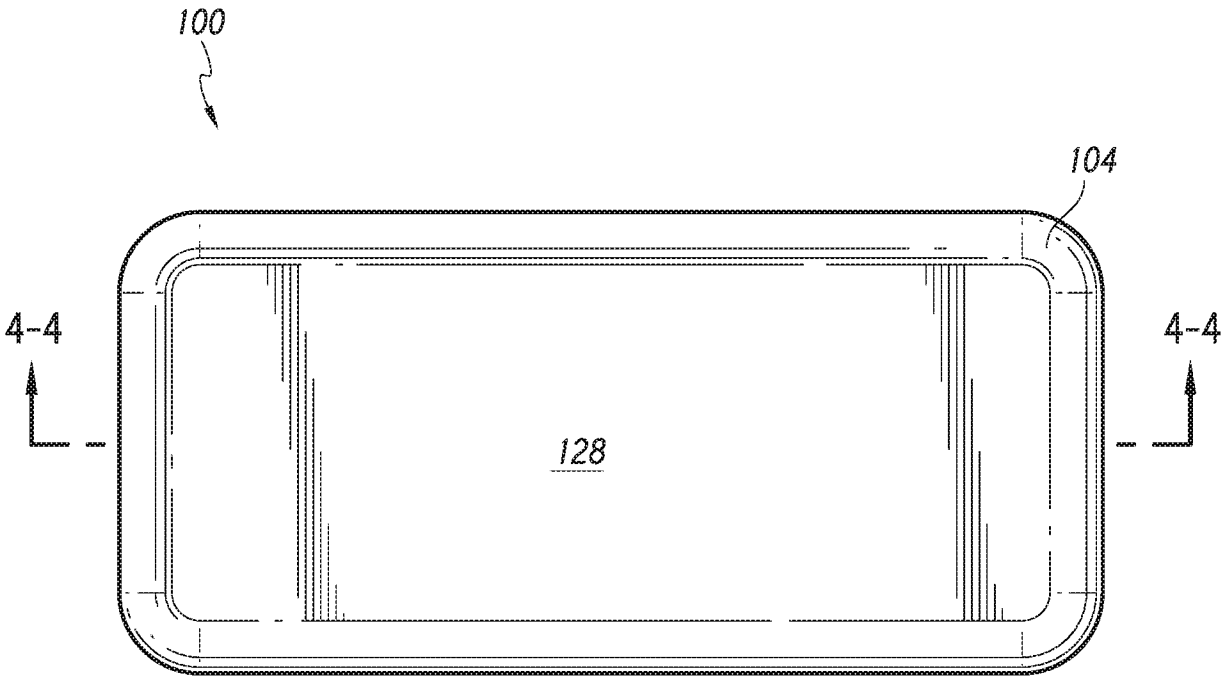
FIG. 3 is at top view of the eraser assembly of FIG. 1.

FIG. 1 shows one embodiment of an eraser assembly 100. The eraser assembly 100 includes a housing 104, a tray 108, and an eraser insert 112. The eraser insert 112 can be a first eraser insert should the eraser assembly 100 be configured to retain multiple inserts, as discussed further below.

Figure 5:
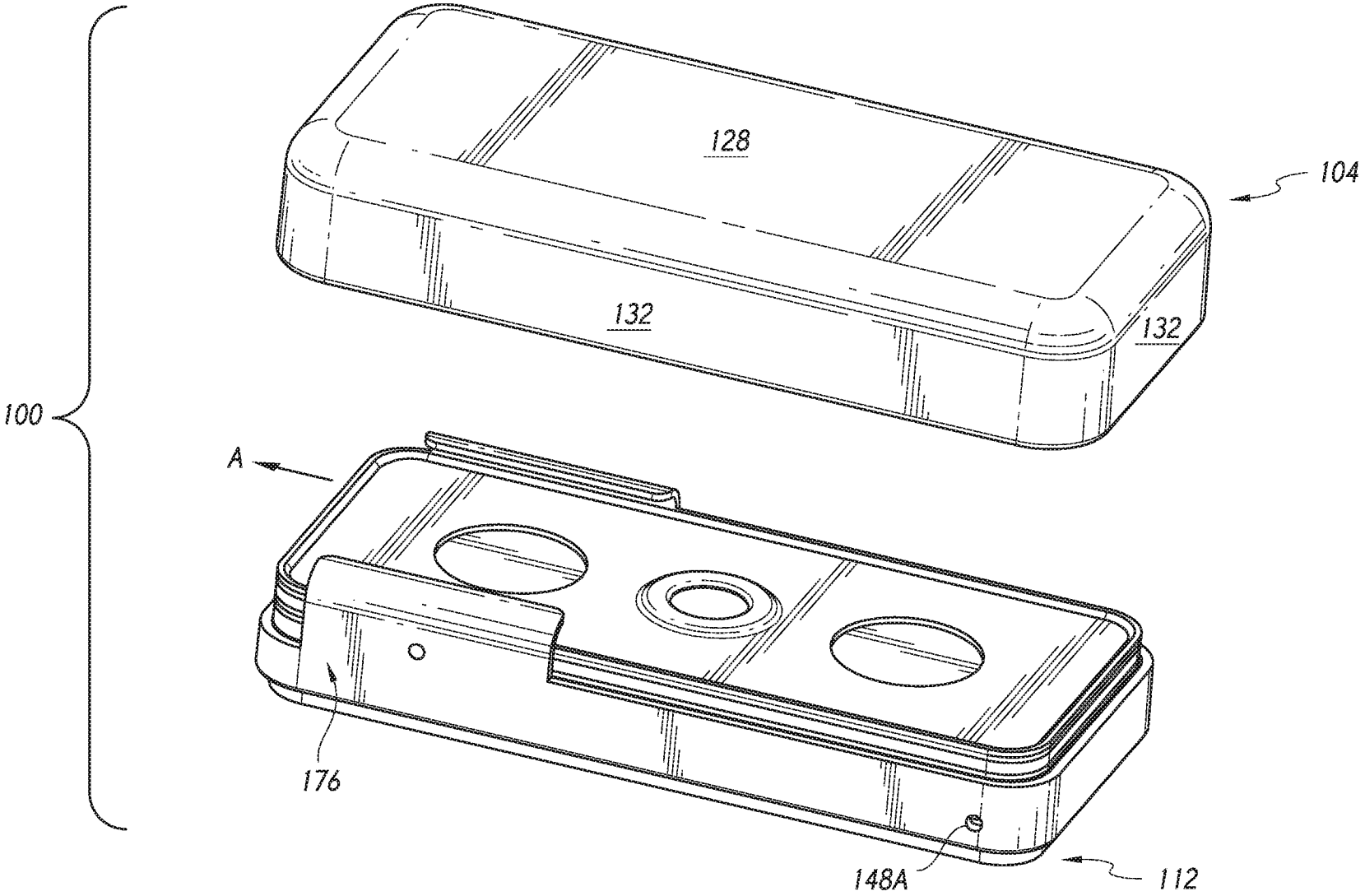
FIG. 5 is a first exploded view of the eraser assembly of FIG. 1.
Figure 5A:
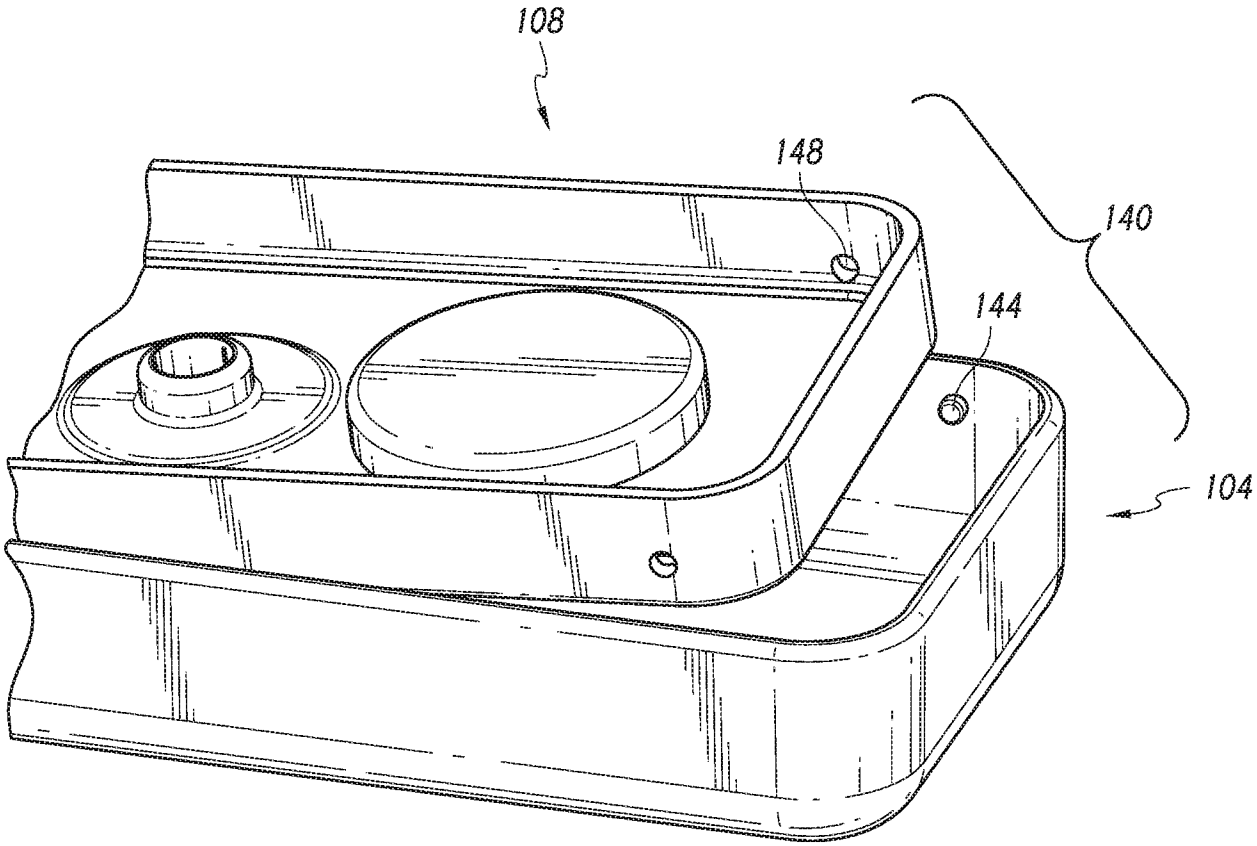
FIG. 5A is a second exploded view of the eraser assembly of FIG. 1.
Figure 6:
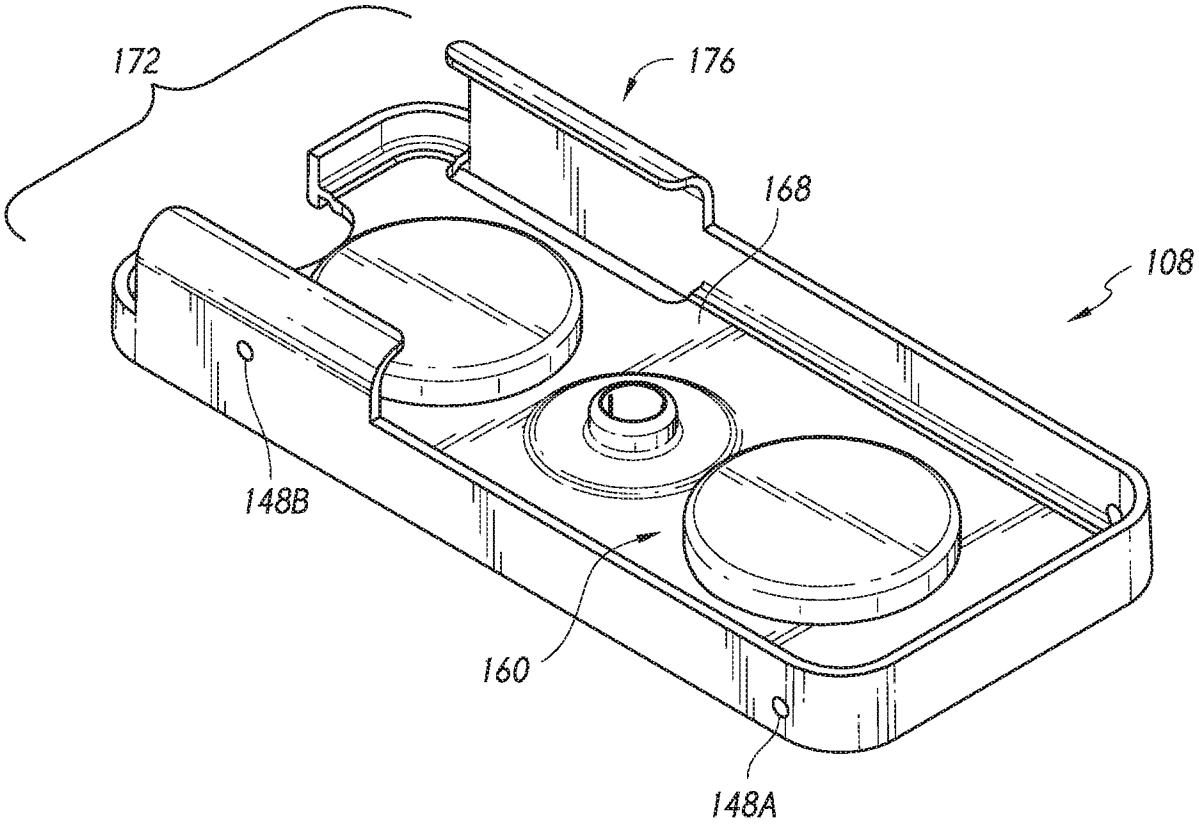
FIG. 6 is a top perspective view of a tray configured to hold one or more eraser inserts in connection with the eraser assembly of FIG. 1.

The housing 104 has a concave shape that includes an interior portion 120. The interior portion 120 is disposed between a top surface 128 and a plurality of outside surfaces 132. FIG. 5A shows that in one embodiment a coupler 140 is provided for connecting the tray 108 to the housing 104. The coupler 140 can be disposed between a surface of the tray 108 and a surface of the housing 104. The coupler 140 can include a post 144 and an aperture 148. One method for coupling the tray 108 with the housing 104 comprises disposing the post 144 in the aperture 148. In one embodiment opposing interior surface of the housing 104 each have a post 144. In one embodiment side surfaces of the tray 108 have apertures 148 configured to receive the posts 144. FIGS. 5 and 6 show that in one embodiment opposite side surfaces of the tray 108 can include a plurality of apertures 148. A first set of apertures 148A (one of which is shown on each of FIGS. 6 and 7) is configured to initially couple with a pair of posts 144. The tray 108 can rotate relative to the housing 104 when the apertures 148A are coupled with corresponding posts 144. An aperture 148 or a second set of apertures 148B (one of which is shown on each of FIGS. 6 and 7) is configured to subsequently couple with a pair of posts 144.

Figure 4:
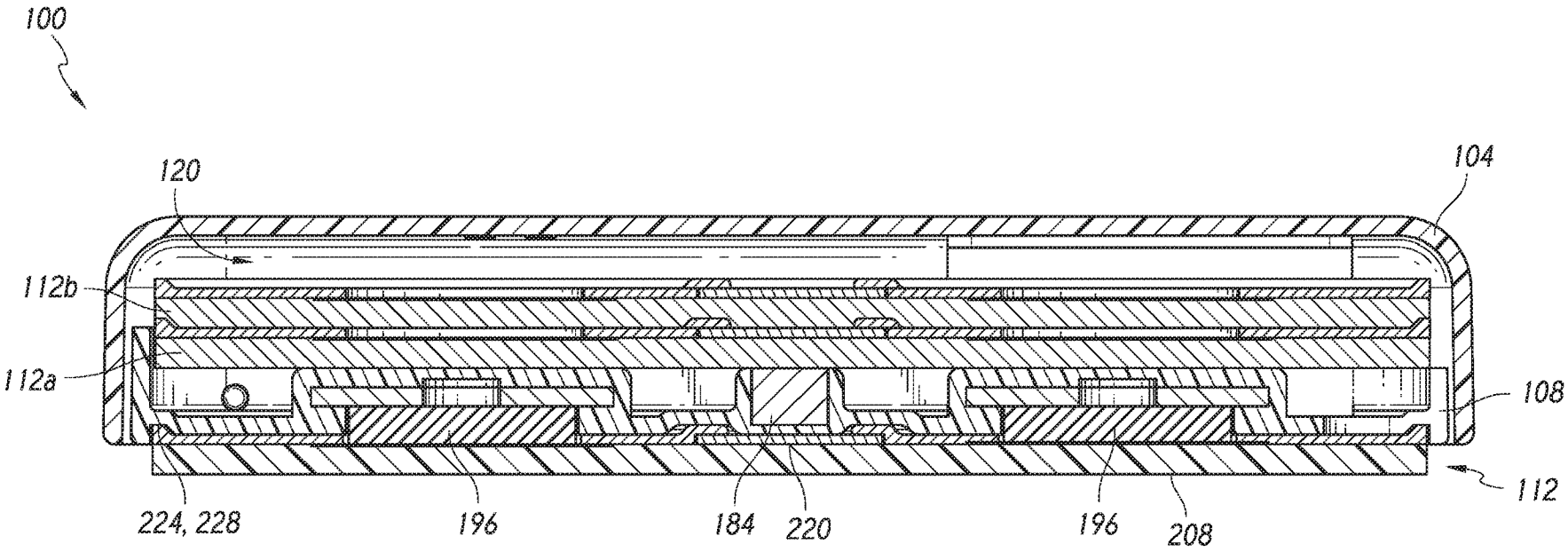
FIG. 4 is a cross-sectional view of the eraser assembly of FIG. 1 taken through the section plane 4-4.

The tray 108 has a retaining portion 160 and a recess 164 disposed opposite of the retaining portion 160. FIG. 4 shows that the retaining portion is disposed in the interior portion 120 of the housing 104 when the eraser assembly 100 is assembled. FIG. 4 shows that the recess 164 is exposed when the tray is coupled with the housing 104. More specifically when the retaining portion 160 is disposed in the interior portion 120 the recess 164 is exposed on an outside surface. This facilitates connecting the eraser insert 112 with the recess 164. The eraser insert 120 is configured to be disposed in the recess 164.

In embodiments where more than one eraser insert is provided, a second eraser insert 112A can be configured to be disposed in interior portion 120. For example, the second eraser insert 112A can be disposed on a lower interior surface 168 facing the interior portion 120. The lower interior surface can be a surface of the tray 108 as discussed further below. A third eraser insert 112B can be disposed on the second eraser insert 112A in the interior portion 120. The second eraser insert 112A can be identical to the eraser insert 112. The third eraser insert 112B can be identical to the eraser insert 112.

Figure 7:
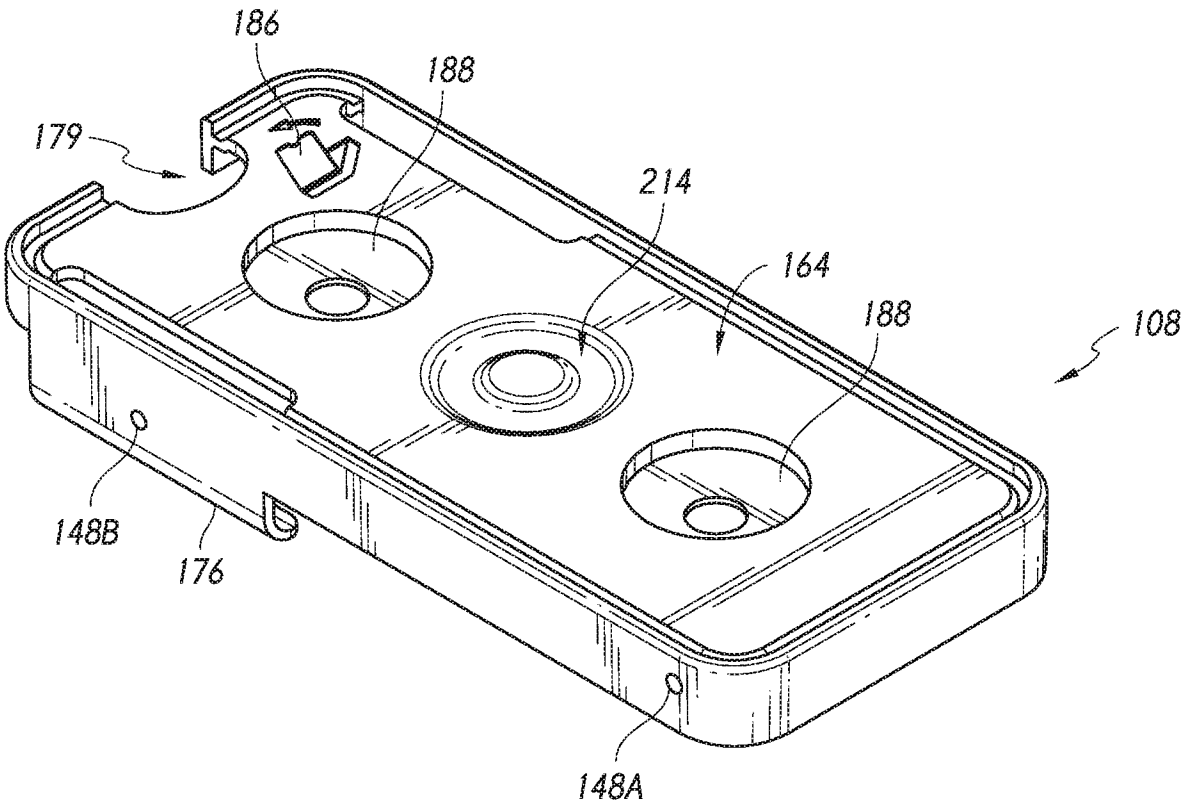
FIG. 7 is a bottom perspective view of the tray of FIG. 6.

FIGS. 5 and 6-9 show that the retaining portion 160 can include a holder 172 that is configured to at least partially surround the eraser inserts 112A, 112B when the inserts are disposed in the retaining portion 160. The holder 172 can include one or a plurality of clips 176. The clips 176 can comprise elongate projections that extend from a side surface of the tray 108. FIG. 6 shows that the clips 176 can comprise elongate projections that have an arcuate profile with a first portion coupled with the side surface of the tray 108 and a second portion disposed transverse to the first portion. The second portion of the clips 176 can extend opposite the interior surface 168. The second portion and the interior surface 168 can together form part of an envelope for retaining one or more eraser inserts 112, 112A, 112B. In one embodiment, a visual indicator 186 shown in FIG. 7 illustrates the structure can be opened. The tray 108 can be rotated out of the housing 104 via the coupler 140 for example.

Replacing the eraser insert 112 with one of the eraser inserts 112A, 112B can be achieved by pivoting the tray 108 out of the housing 104 about a rotational axis extending perpendicular to the long side of the housing 104 and through the apertures 148A. When so pivoted the end of the tray 108 adjacent to the clip 176 and an access aperture 179 are exposed. When so exposed, one of the inserts 112A, 112B can grasped by the user through the access aperture 179 and pulled along the direction indicated by the arrow A in FIG. 5 to remove the insert from the tray 108. Thereafter, the insert 112A, 112B can be mated with the recess 164 as discussed further below.

Figure 8:
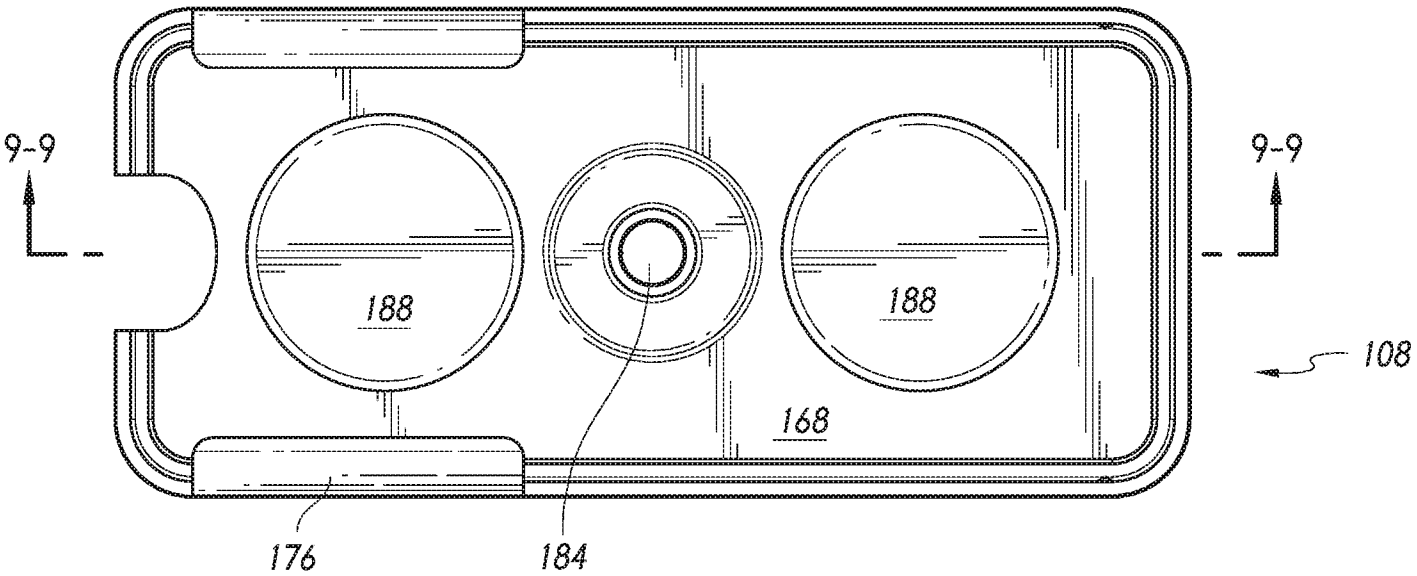
FIG. 8 is at top view of the tray of FIG. 6.
Figure 9:
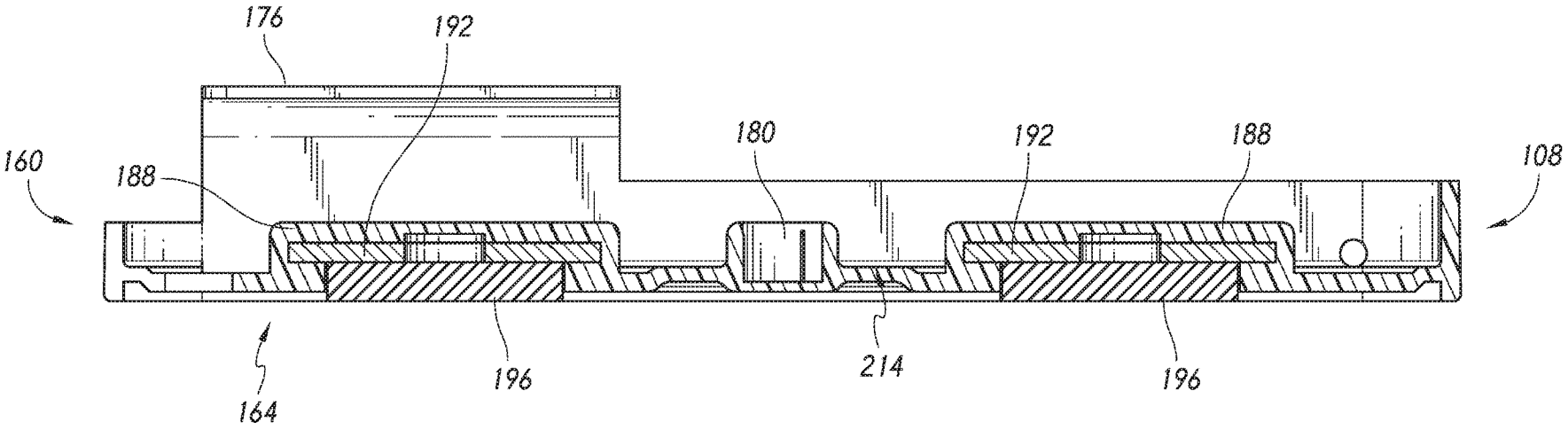
FIG. 9 is a cross-sectional view of the tray of FIG. 8 taken through the section plane 9-9.
Figure 10:
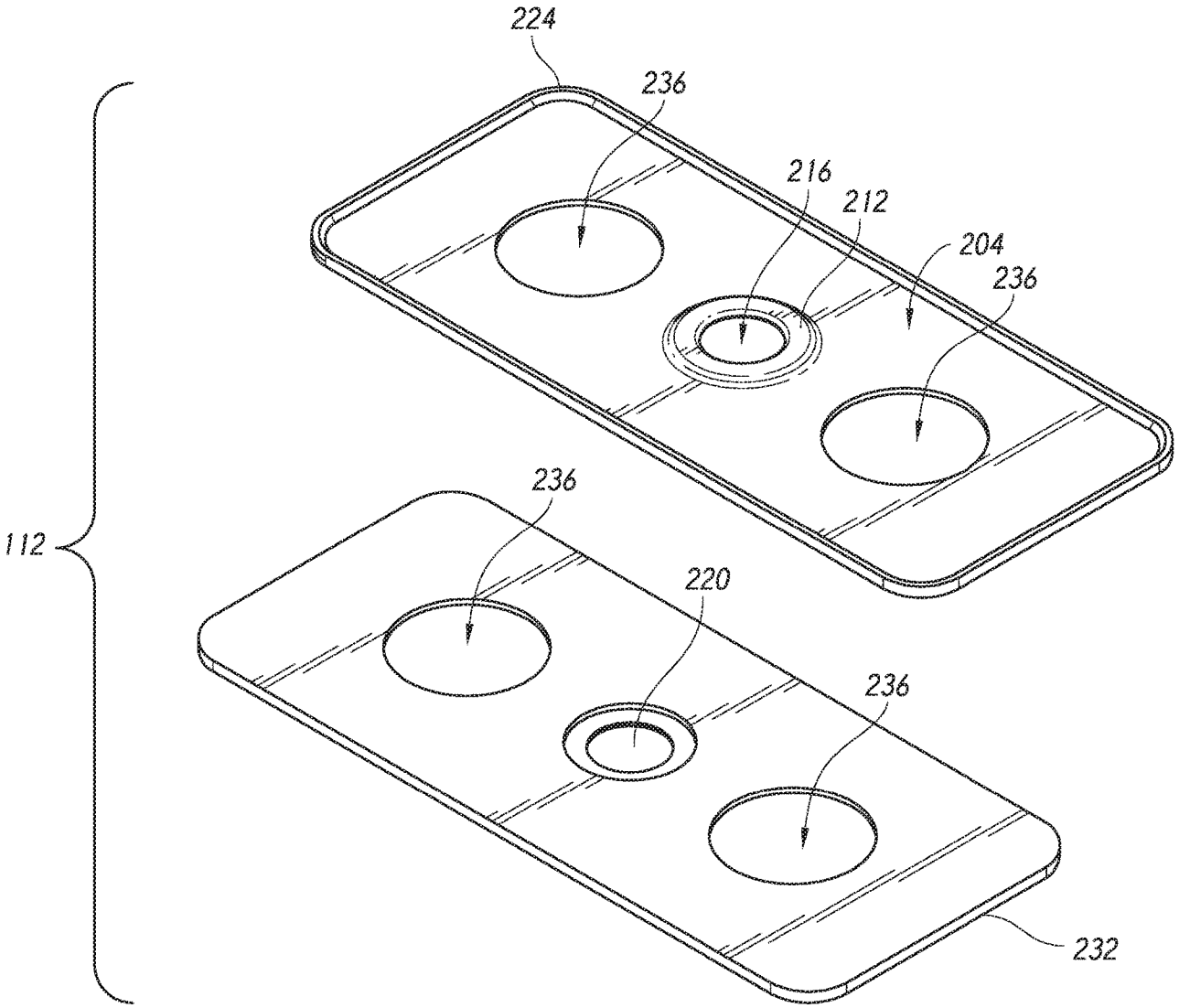
FIG. 10 is an exploded view of a base assembly of an eraser insert of the eraser assembly of FIG. 1.
Figure 11:
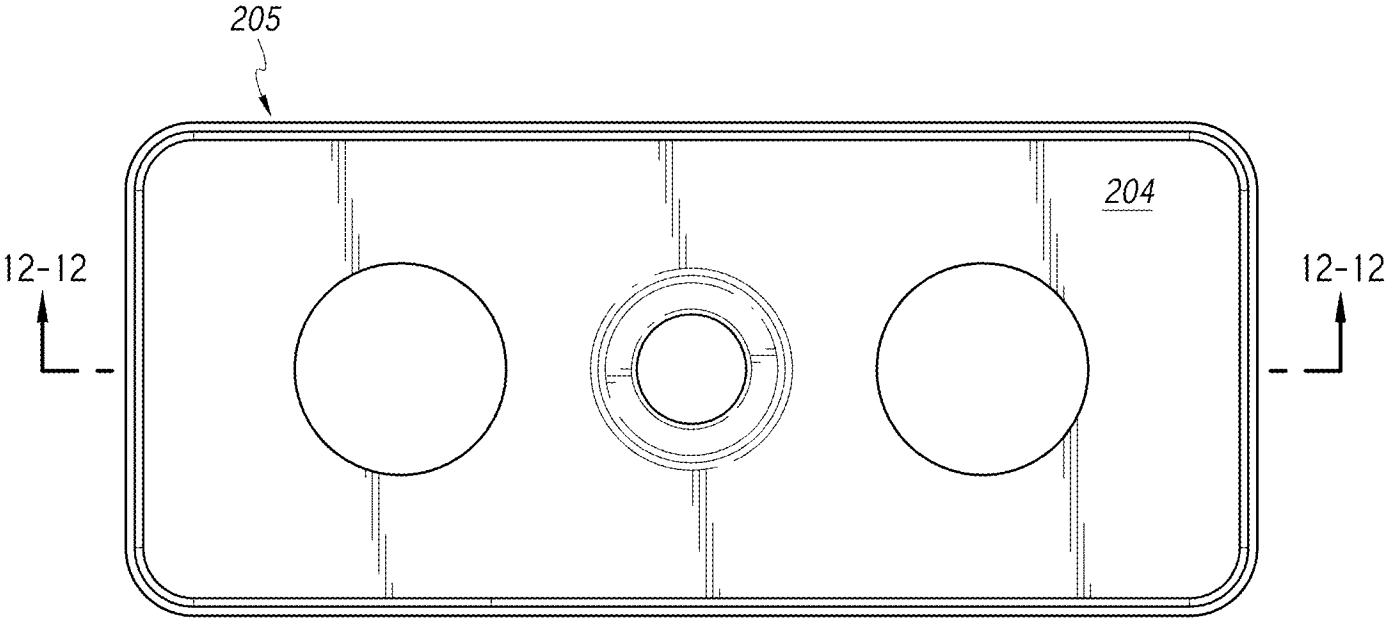
FIG. 11 is a top view of a tray interface of the eraser insert of the eraser assembly of FIG. 1.
Figure 12:
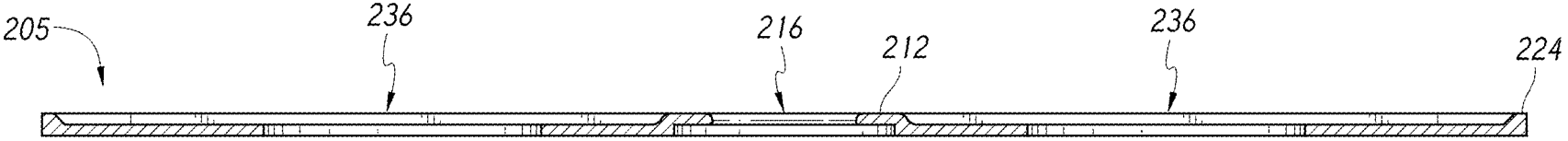
FIG. 12 is a cross-sectional view of the tray interface of FIG. 11 taken through the section plane 12-12.

FIGS. 8 and 9 show that in one embodiment the surface 168 comprises a recess 180 configured to receive a magnet 184. The recess 180 can include an open end and a closed end. The open end can be accessible in or from the retaining portion 160. The magnet 184 can be secured in the recess 180 in any suitable manner, such as by friction fit, interference fit, adhesives, or other conventional means. Also, the surface 168 can include a projection 188 housing a magnet retention feature. The projection 188 can be formed as an overmold entrapping a member 192 that is magnetically attracted to a magnet 196. The projection 188 preferably is configured such that the eraser insert 112A can rest thereon and be supported thereby as shown in FIG. 4. The magnets 196 preferably have sufficient strength to support the eraser assembly 100 on a white board or a glass board or on another marking board.

FIGS. 4 and 10-13 illustrate the eraser insert 112. As noted above, some embodiments of the eraser assembly 100 can house additional eraser insert 112A, 112B. The inserts 112, 112A, 112B can be identical. The eraser insert 112 can include a first side 204 that faces the recess 164 and a second side 208 opposite the first side 204. The second side 204 can comprise a felt pad or other material suitable for rubbing or wiping markings off of a board. The first side 204 can comprise a plate body 205 (see FIGS. 11-12) having an interface for mating with the recess 164. For example a raised annular region 212 can surround an aperture 216. The raised annular region can be received in an annular depression or well 214 disposed in the recess 164. The aperture 216 can allow a steel member 220 or other magnetically attractable member to be exposed on the first side 204. The steel member 220 can be enclosed by a layer 232 disposed between the first side 204 and the second side 208. The interface also can include a peripheral rim 224 that can be received in and retained in a well 228 formed in the recess 164. One or both of the structures including the first side 204 and the layer 232 can have apertures 236 configured to permit the magnets 196 to protrude through the eraser insert 112 such that the separation between the magnets 196 and the board to which the eraser assembly 100 can be magnetically mounted is lessened or reduced than had the magnets 196 been entirely disposed between the first side 204 and the recess 164. The protruding nature of the magnets 196 is illustrated in FIG. 4.

The interface between the insets 112, 112A, 112B and the recess 164 is advantageous in that multiple forms of securement are provided. The magnet 184 and the steel member 220 are attracted to provide releasable connection between these components. Additionally, because the rim 224 is disposed in the well 228, the insert 112, 112A, 112B is provided with a way to oppose dislodgement due to friction and other loading generally in the plane of the side 208. That is rubbing on the board 80 discussed below could cause the edges of the side 208 to separate from the recess 164. However, by disposing the rim 224 within the well 228 such separation is reduced or eliminated.

The second side 208 of the can be disposed on one side of a layer 250 that is the bottom layer of the eraser assembly 100. An opposite side of the layer 250 can include an adhesive for connecting the layer to the layer 232 shown in FIG. 10. Thus, some embodiments provide that the eraser inserts 112, 112A, 112B have a three layer structure. In some variations, the layers 232 and 250 can be a single layer in which the apertures 236 in the layer 232 are recesses that extend only part way through. The steel member 220 can rest on the combined layer providing a smooth side 208 where the presence of the magnets 196 and the steel member 220 is not apparent. This reduces the chance of direct contact between these components and the marking board which could potentially result in scratches or other damage to the marking board.

In another embodiment, an eraser assembly is provided that includes a housing, a tray, and a coupler disposed between a surface of the tray and a surface of the housing. The housing has a concave shape including an interior portion. The tray has a retaining portion disposed in the interior portion and a mounting portion disposed opposite of the retaining portion. The coupler is configured to releasably hold the tray to the housing. An eraser insert is disposed in the interior portion and is enclosed therein by the tray.

In another embodiment, an eraser assembly is provided that includes a housing, a mounting portion, and an eraser insert. The housing has a convex form. The mounting portion comprising a magnet configured to magnetically secure the eraser assembly to a board, e.g., a blackboard, a whiteboard, and a glassboard. The eraser insert is configured to couple with the mounting portion. The eraser insert configured to at least partially receive the magnet when so coupled.

Figure 14:
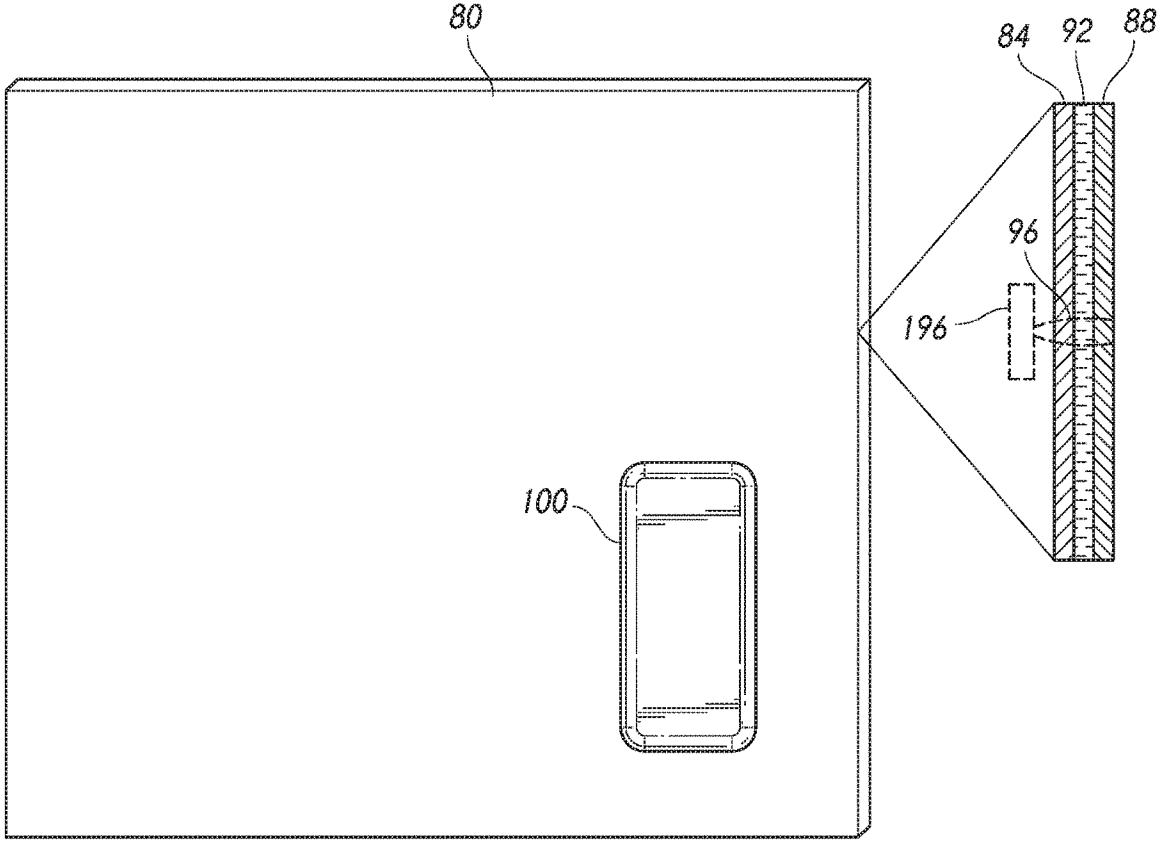
FIG. 14 illustrates an environment for use of the eraser assembly and also illustrates a system including a marking board and the eraser assembly of FIG. 1.
Figure 13:
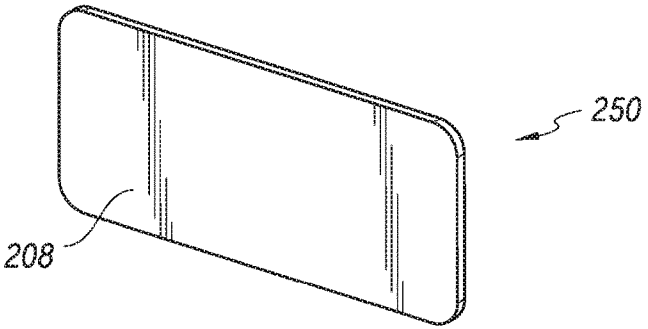
FIG. 13 is a perspective view of a erasing member of the eraser insert of the eraser assembly of FIG. 1.

FIG. 14 shows one type of board 80 with which the eraser assembly 100 is particularly well suited. The board 80 has multiple layers, including an exposed layer 84 adapted for being written on by a marker (not shown) and a ferrous layer 88. An intervening layer 92 is shown, and may include an adhesive or in fact include more than one layer for other purposes. In some cases, the ferrous layer 88 and the exposed layer 84 are immediately adjacent to each other. In some boards 80 the exposed layer 84 is a layer of glass having a thickness of about one-eight inch or more, e.g., up to about one-half inch or more. In some applications, the board 80 the exposed layer 84 is a white coating layer applied directly to the ferrous layer 88.

In one application the eraser assembly 100 can be coupled with the board 80, which can have a ferrous metal, e.g., steel, with a thickness between about 0.003 inch and about 0.25 inch. The ferrous metal may be coated but otherwise direct contact can be provided between the assembly 100 and the ferrous metal. Any type of magnetic material having between about 5 MGOe and about 25 MGOe and measurable surface gauss between about 1 and about 3000 can be used for the magnet or magnets 196. In another application, the assembly 100 can be coupled with a glassboard having a non-ferrous material with thickness between ⅛ inch to ½ inch with ferrous backing with a thickness of about 0.003 inch to about 0.25 inch. In the glassboard applications, a magnetic material between about 25 MGOe and about 60 MGOe or higher, and measurable surface gauss between about 3000 and about 10000 Gauss or higher can be used.

FIG. 14 also show a magnetic field 96 in the context of the board 80. The magnetic field 96 extends in a direction away from the magnet(s) 196 disposed in the assembly 100 and can extend into the board 80 in use. The field 96 is illustrated for simplicity by one dashed line, though the magnetic field generated by the magnet 196 can be strong and could correspond to a highly dense arrangement of flux lines. The field 96 is shown in the inset image, as extending from the magnet 196 through one or more layers to the ferrous layer 88. In the inset image the magnet 196 is shown alone for ease of illustration, but would be coupled with the assembly 100 and would be acting through the side 208 and possibly intervening layers as discussed above. The magnet(s) 196 is or are strong enough to self-support the eraser assembly 100 eliminating the need for at ray and reducing the chance that the eraser assembly 100 will be lost or not available in use. The magnet(s) 196 is or are strong enough to increase the normal force to the board 80 such that the wiping or cleaning is more effective. That is, the user can apply less force into the board 80 because the magnet(s) 196 are generating some or all of the needed force into the board. The user can focus the force they apply in a lateral or vertical direction, or more generally, in a plane parallel to the plane of the board 80. The normal force of the magnet 196 is not so much as to make the lateral force difficult to apply but is sufficient to support the eraser assembly 100 when not in use.

As used herein, the relative terms "top" and "bottom" shall be defined from the perspective of what is visible to the user when the eraser assembly is held around the housing 104. Thus, top refers the direction toward the exposed side of the housing 104 farthest from the side 208, while bottom refers to the direction toward the side 208.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An eraser assembly, comprising:

a housing comprising an interior portion;

a mounting portion disposed opposite the housing, the mounting portion comprising a recess and a plurality of magnets configured to magnetically secure the eraser assembly to a board; and an eraser insert configured to couple with the mounting portion, the eraser insert comprising an eraser pad attached to a plate body, a plurality of apertures extending from an outside surface of the plate body completely through the plate body, each one of the apertures of the plurality of apertures configured to removably receive at least a portion of a corresponding magnet of the plurality of magnets of the mounting portion when so coupled, wherein the eraser insert comprises a first side and a second side opposite the first side, the first side comprising a first insert surface configured to face the recess of the mounting portion and a raised peripheral rim extending away from the first insert surface and away from the second side of the eraser insert;

wherein the recess of the mounting portion comprises a first surface and a second surface disposed lower than the first surface, the second surface comprising a well that is configured to receive the raised peripheral rim of the eraser insert such that the raised peripheral rim extends lower than the first surface of the recess when the first insert surface is placed against the first surface of the recess of the mounting portion.

2. The eraser assembly of claim 1, wherein the eraser pad is disposed on the second side of the eraser insert.

3. The eraser assembly of claim 2, wherein the plate body is disposed on the first side of the eraser insert and an intermediate layer is disposed between the plate body and the eraser pad.

4. The eraser assembly of claim 1, wherein the raised peripheral rim of the eraser insert is disposed on at least two transverse portions of the first side of the eraser insert.

5. The eraser assembly of claim 1, wherein the raised peripheral rim of the eraser insert is disposed about an entire periphery of the first side of the eraser insert.

6. The eraser assembly of claim 1, wherein the first side of the eraser insert further comprises an annular region projecting away from the first insert surface disposed inward of an outer periphery of the first side.

* * * * *